US010619354B1

(12) United States Patent
Simonsen

(10) Patent No.: US 10,619,354 B1
(45) Date of Patent: Apr. 14, 2020

(54) INSULATION AND FACADE MOUNTING SYSTEM

(71) Applicant: David Simonsen, Redding, CA (US)

(72) Inventor: David Simonsen, Redding, CA (US)

( * ) Notice: Subject to any disclaimer, the term of this patent is extended or adjusted under 35 U.S.C. 154(b) by 0 days.

(21) Appl. No.: 15/983,861

(22) Filed: May 18, 2018

(51) Int. Cl.
*E04F 13/08* (2006.01)
*E04B 1/76* (2006.01)

(52) U.S. Cl.
CPC ..... *E04F 13/0876* (2013.01); *E04B 1/7629* (2013.01); *E04F 13/0808* (2013.01); *E04F 13/0869* (2013.01); *E04F 2201/05* (2013.01)

(58) Field of Classification Search
CPC ..... E04F 13/0876; E04F 13/0869; E04F 13/0808; E04F 2201/05
USPC ..... 52/235, 506.06
See application file for complete search history.

(56) References Cited

U.S. PATENT DOCUMENTS 2,292,984 A * 8/1942 Alvarez, Jr. ..... E04F 13/0803 52/409
5,065,557 A * 11/1991 Laplante ..... E04B 2/96 52/235
5,673,529 A * 10/1997 Treister ..... E04C 2/288 52/235
5,819,486 A * 10/1998 Goodings ..... E04F 13/0816 52/235
5,860,257 A * 1/1999 Gerhaher ..... E04F 13/0826 52/235
6,055,787 A * 5/2000 Gerhaher ..... E04F 13/0826 52/506.06
6,170,214 B1 * 1/2001 Treister ..... E04F 13/0808 52/235
7,043,884 B2 * 5/2006 Moreno ..... E04F 13/0808 52/235
7,726,083 B2 * 6/2010 Wagner ..... E04F 13/0812 52/235
7,849,651 B2 * 12/2010 Fujito ..... E04F 13/0889 248/216.1
8,826,620 B2 * 9/2014 Krause ..... E04F 13/0817 52/506.08
8,833,025 B2 * 9/2014 Krause ..... E04F 13/0828 52/506.08
9,109,368 B2 * 8/2015 MacKenzie ..... E04F 13/0803
9,151,052 B2 * 10/2015 Krause ..... E04F 13/0828
10,221,574 B2 * 3/2019 Krause ..... E04F 13/0846
2017/0138060 A1 * 5/2017 Newell ..... E04F 13/08

* cited by examiner

*Primary Examiner* — Adriana Figueroa
(74) *Attorney, Agent, or Firm* — Theodore J. Bielen, Jr.

(57) ABSTRACT

A system for mounting a facade and an insulation body to a structure utilizing a base member that includes a first portion attached to the structure. The base member includes a platform for supporting the insulation body and a flange extending outwardly from the platform. The flange includes attachment mechanisms for holding a panel or frame to form a facade.

7 Claims, 8 Drawing Sheets

30
20
18
14
16
36
21
32
34
26
10A
28
24
22
52
56
40
42
54
50
46
44
38
48
12
62

INSULATION AND FACADE MOUNTING SYSTEM

CROSS REFERENCES TO RELATED APPLICATIONS

The present application claims the benefit of U.S. Provisional Patent Application 62/508,453, filed 19 May 2017.

BACKGROUND OF THE INVENTION

The present application relates to a novel and useful system for mounting facade material, including insulation on building structures and the like.

Facade panels are often employed to cover building exterior walls in order to provide protection from the elements and also to add aesthetics to a structure.

Many panel systems have been used in the past that are installed in a progressive style or in a non-progressive style on a building. Prior facade mounting systems have often been uneconomical and lacking in versatility when used with a variety of base profiles and facade materials.

A recent advance in panel mounting systems may be found in U.S. Pat. No. 9,903,123. In that patent, a novel fastening method is revealed which greatly reduces the time and cost for mounting panels to create a facade on a building structure.

A panel mounting system that is compatible with the concomitant edition of insulating bodies against a building structure would be a notable advance in the building construction arts.

SUMMARY OF THE INVENTION

In accordance with the present application, a novel and useful insulation and facade mounting system is herein provided.

The system of the present application utilizes one or more insulation bodies. Base member is formed with a first portion that is intended to be positioned against a surface such as a building structure and a platform extending from the first portion that includes a surface configured for supporting the insulation body. The base member further includes a flange that extends from the platform and may possess a gutter and a terminal wear strip adjacent the gutter.

A frame is also provided in the present application and includes a latch that mates with the flange of the base member. Specifically, the latch may contact the terminal wear strip found on the flange of the base member.

The first portion may be further fashioned with a slot that accommodates a strip adjacent the flange. The strip may be employed to aid in the structure support of the base member to a building structure.

In certain aspects of the application, the flange of the base member may be provided with a connector that meets with the latch of the frame. Such connection may include a variety of connector structures, such as a pin and hook mechanism. In addition, a plate may be employed to maintain such connection in place.

The base member of the above described application may be employed with like base members to sandwich insulation members therebetween and to extend along a building structure surface. In addition, multiple frames may be employed with the connector found on the flange of the base member in 2-way and 4-way panel fastening arrangements by the use of specialized connectors mounted to the flange. In other words, the connectors on the base member flange provide a device to lock two adjacent panels together (2-way) or to lock four abutting panels together (4-way). Such connectors may take the form of mounting strips fixed to the flange or that slidably engage the flange and are, thus, able to be positioned in various places along the flange.

It may be apparent that a novel and useful facade mounting system has been hereinabove described.

It is therefore an object of the present application to provide a facade mounting system that results in facade base profiles that are economically placed on a building structure.

Another object of the present application is to provide a facade mounting system that is compatible with support insulation bodies positioned adjacent the facade.

Another object of the present application is to provide a facade mounting system that is compatible with insulation members and is capable of mounting the insulation and facade materials in a progressive or non-progressive manner to create a rain screen or to add weatherproofing to a building or structure upon which the facade is being mounted.

Another object of the present application is to provide a facade mounting system that may be utilized on both interior and exterior insulated walls of a structure and provides varying facade depths while adding sheer value to the walls.

Another object of the present application is to provide a facade mounting system that includes a base extrusion or base member that may be mounted vertically, horizontally, diagonally, or any combination thereof, and performs multiple separate functions such as stand-off, added shear value to the structure, support of facade materials, containment of filler media, provision of fire resistance, water proofing of the structure, and providing areas for attachment of various components.

Another object of the present application is to provide a facade mounting system that may be used in continuous lengths or short segments and is capable of supporting insulation and facade materials adjacent a structure.

Another object of the present application is to provide a facade mounting system that is capable of utilizing support mechanisms found in the prior art for linking facade materials.

Another object of the present application is to provide a facade mounting system that may be employed as an attachment to window nailing flanges, flashings, tie backs, and other objects found on a building.

Another object of the present application is to provide a facade mounting system that is capable of installing new facade material directly over existing facade materials, such as metal buildings having roll formed panels.

Another object of the present application is to provide a facade mounting system that includes extrusions and/or pultrusions manufactured and/or fabricated from various materials, such as aluminum, stainless steel, and the like.

Another object of the present application is to provide a facade mounting system that allows for aligned reveals and allows the thermal expansion and contraction of the facade materials.

Another object of the present application is to provide a facade mounting system having aligned bases with insulation members between parallel bases that help to prevent the deflection of the bases.

Another object of the present application is to provide a facade mounting system adding structural support to the facade materials, which may take the form of a variety of entities, such as brick and mortar, phenolic resin, panels, cementatious, ACM panels, and the like.

Another object of the present application is to provide a facade mounting system that includes base extrusions facilitating planing and leveling on a wall or surface.

Another object of the present application is to provide a facade mounting system that provides insulation, fire protection, and noise, and/or impact resistance due to multiple cavities that are formed by the system relative to the structure of the building on which the system is being employed.

Another object of the present application is to provide a facade mounting system that is compatible with poor substrate conditions on the building being covered and eliminates the necessity of mounting base extrusions in multiple directions.

Another object of the present application is to provide a facade mounting system that aids in the detection of misaligned apertures on the building structure and allows the fabrication of odd-shaped facade materials for installation.

Another object of the present application is to provide a facade mounting system that includes a base extrusion having a thermal break attribute may be adapted to mount facade materials horizontally or vertically.

Another object of the present application is to provide a facade mounting system that is compatible with the support of insulation bodies composed of various materials, such as polystyrene, polyisocyanurate, mineral wood, or any liquid foams that harden over time.

Another object of the present application is to provide a facade mounting system that includes structures having indicators or lineal markers for use as reference points for drilling, screwing, measuring, and for other reference uses.

Yet another object of the present application is to provide a facade mounting system that accommodates water intrusion and allows water drainage away from the building to avoid water buildup against the building.

The invention possesses other objects and advantages especially as concerns particular characteristics and features of which will become apparent as the specification continues.

Figure 1:
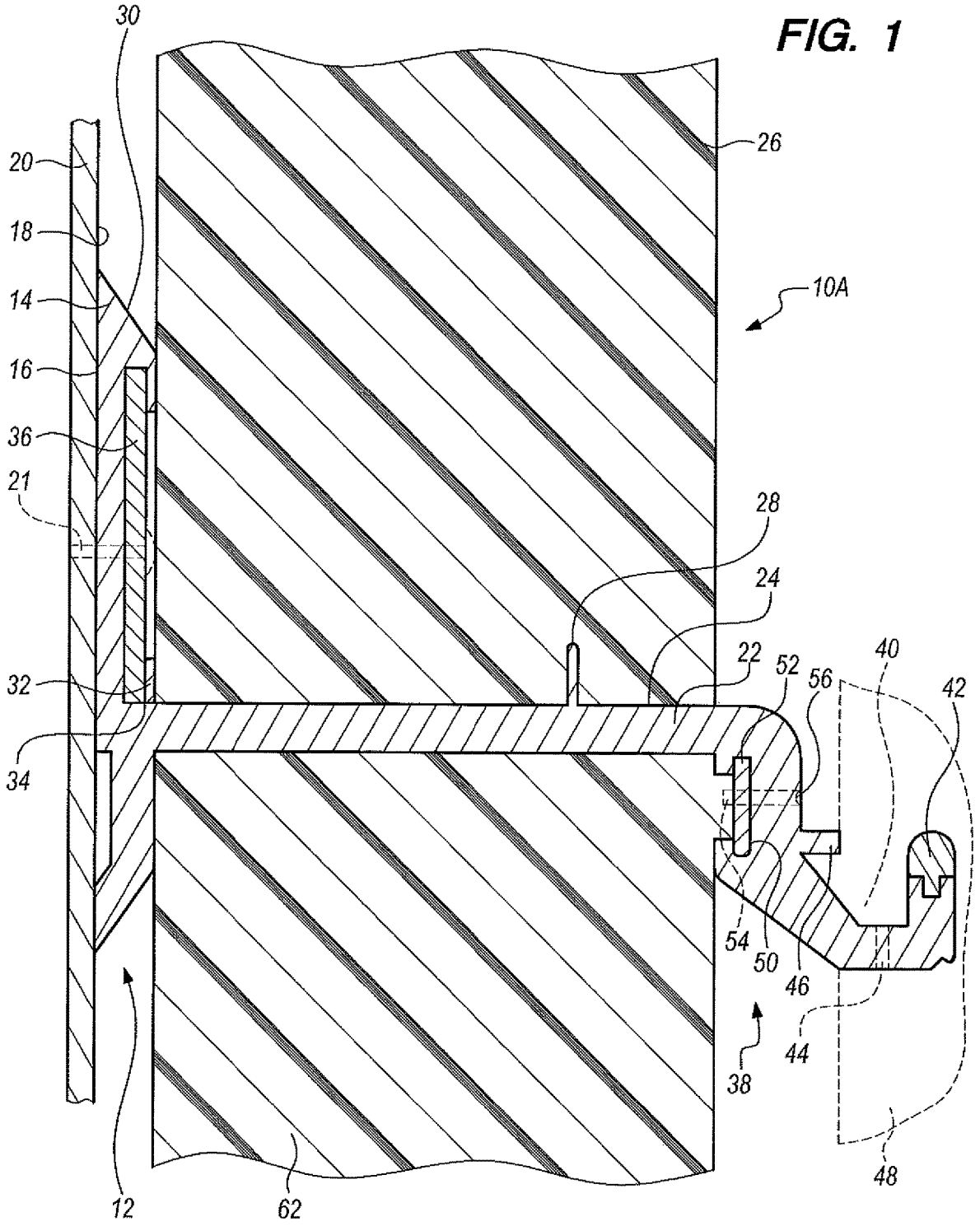
FIG. 1 is a sectional view of an embodiment of the present application.

For a better understanding of the application, reference is made to the following detailed description of the preferred embodiments which should be referenced to the prior described drawings.

DETAILED DESCRIPTION OF THE PREFERRED EMBODIMENTS

Various aspects of the present application will evolve from the following detailed description of the preferred embodiments thereof, which should be referenced to the prior described drawings.

The system of the present application as a whole is depicted by reference character 10 followed by an upper case letter to denote various embodiments of the same.

Turning to FIG. 1, it may be observed that system 10A of the present application is shown. System 10A includes a base member or base extrusion 12. Base member 12 is a metal extrusion, a metal extrusion with thermal breaks, a pultrusion, or the like. Base member 12 structurally resists "racking" of a structure that is employed to hold loads, such as cladding and other facading to a structure, which will be described in detail as the specification continues. Base member 12 may be employed in continuous lengths or used in short segments. Base 12 is intended to be able to wrap an entire building or structure in a similar modular fashion so that more than one kind of cladding material may be employed. Thus, base 12 may be considered to be a rigid member and as such includes a first portion 14 having a surface 16 which lies against the surface 18 of building structure 20. In this regard, fasteners, such as fastener 21, are employed to hold first portion 14 of base member 12 in place against surface 18 of building structure 20. Base member 14 also includes a platform 22 that extends outwardly from first portion 14. Platform 22 is provided with a surface 24 configured for supporting an insulation body. Protrusion or fin 28 juts from surface 24 and aids in the holding or supporting of insulation body 26. First portion further includes a beveled surface 30 which aids in the placement of insulation body 26 on surface 24.

In addition, it should be realized that first portion 14 and platform 22 form an open cavity 32 sized to accommodate insulation body 26. First portion 14 also is formed with a slot which holds a strip 36 serving as a structural support reinforcement for base member 12. It should be noted that fastener 21 extending through first portion 14 also passes through strip 36 when it is employed in the present embodiment. Insulation 26 may take the form of polystyrene, polyisocyanurate, mineral wool, or liquid foam that hardens over time. Insulation body 26 is intended to insulate the exterior of building structure 20 and, to a certain extent, serves to anchor base 12 through its weight. Insulation body 26 also serves to prevent energy transfer into building structure 20 in the form of thermal energy, noise, impact, and fire.

Looking again at FIG. 1, it may be observed that platform 22 terminates in a flange 38 that extends beyond insulation body 26. Flange 28 is formed with a gutter 40 and a terminal wear strip 42. Gutter 40 is also provided with a drain hole or aperture 44. Flange 38 is further provided with a protrusion 46 that acts with wear strip 42 to hold items such as frame 48 in a relatively level position. Frame 48 will be further discussed as the specification continues. Also, flange 38 is built with a slot 50 that accommodates a strip 52 to fasten items to flange 38 via fastener 54. Indent 56 serves as a lineal reference that marks a place where holes may be drilled to attach strip 52 into slot 50.

Figure 2:
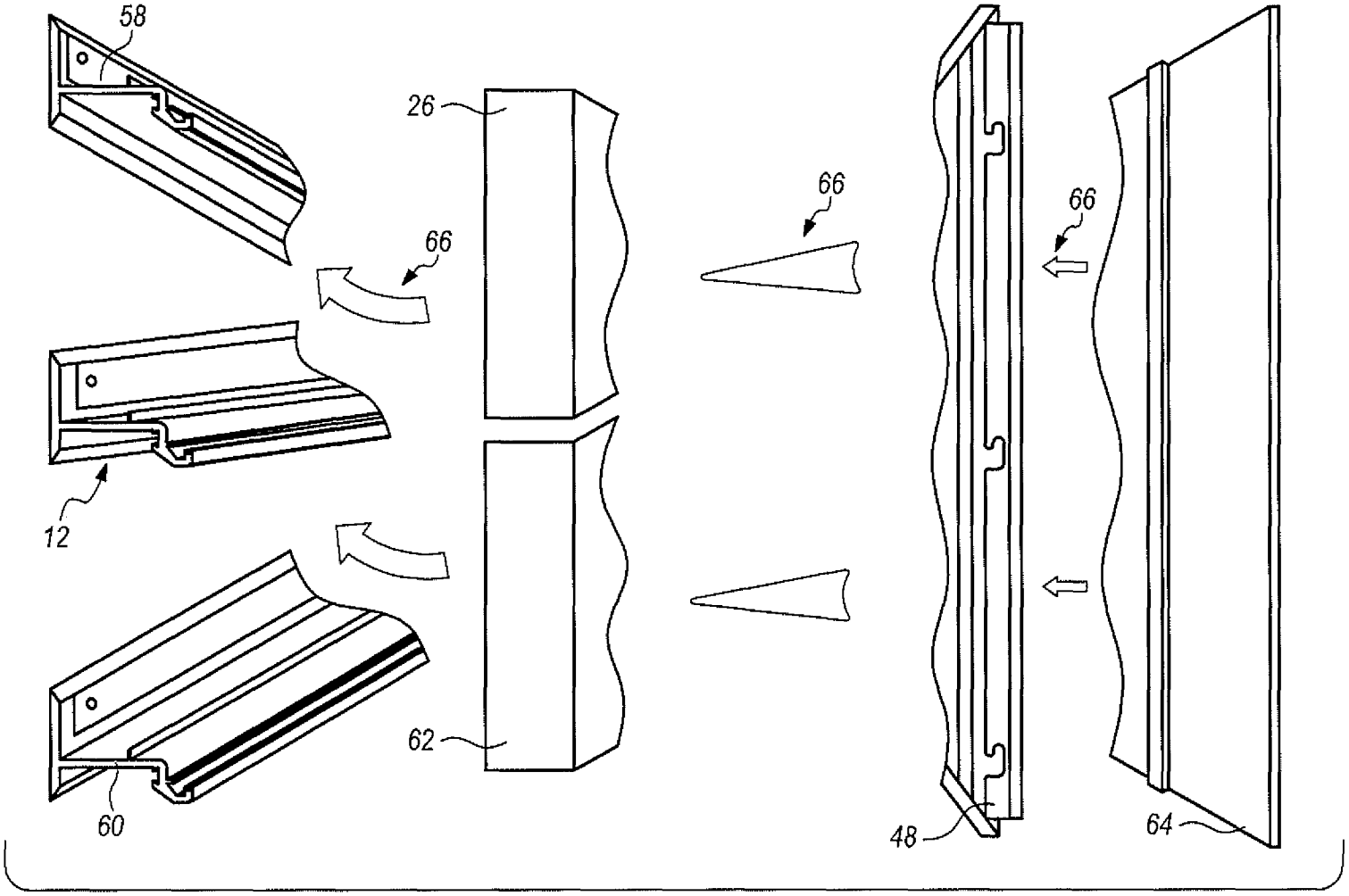
FIG. 2 is an exploded asymmetric view showing the combination of a trio of base extrusions, a pair of insulation members, a frame, and a panel.

With reference now to FIG. 2, it may be seen that the assemblage of items relative to base member 12 and identical base members 58 and 60 is shown. It should be understood that base members 58 and 60 are attached to structure 20 in the same manner as base member 12. In addition, insulation body 26 is shown with a similar insulation body 62 which is intended to lie below platform 22 of base member 12 on FIG. 1. Facade material 64 is normally attached to frame 48 in a conventional manner. For example, the fastening method shown by U.S. Pat. No. 9,903,123 would suffice in this regard and such patent is incorporated by reference as a whole to this application. Plurality of directional arrows 66 indicates the assemblage order.

Figure 3:
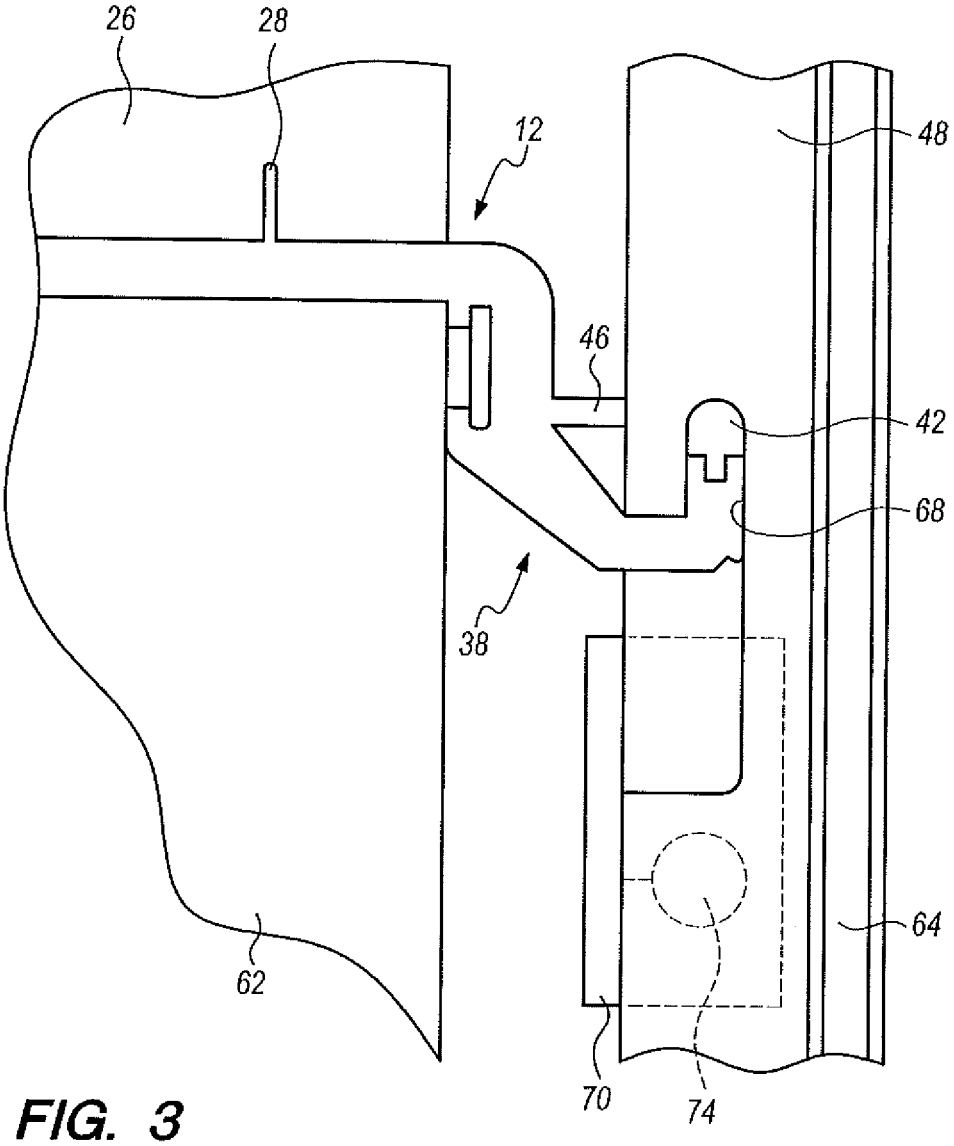
FIG. 3 is a side elevational view of the flange portion of the embodiment of FIG. 1 engaging a frame member.

Turning now to FIG. 3, it may be seen that panel material 64 has been mounted to frame 48. Frame 48 is formed with a hook slot 68 that fits over terminal wear strip 42 and against protrusion 46 of flange 38. Frame 48 may be made of stainless steel, aluminum, and the like, and are used to support a variety of facade items, such as ones of brick and mortar, ACM panels with or without frames, metal panels, cementatious board, phenolic resin panels, and the like. It should be noted that panels without frames would possess hook slots such as hook slot 68 in frame 48. Also, mounting hardware for multiple panel systems may be employed with base member 20.

Figure 4A:
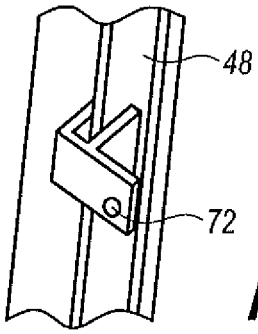
FIG. 4A is a top right perspective view of a portion of the frame of FIG. 3 showing a held reveal guide.

With reference to FIG. 4A, it may be apparent that a typical reveal guide 72 is held by frame 48. A multiplicity of such guides may lie along frame 48 and are aligned vertically.

Figure 4B:
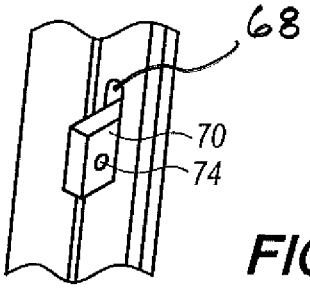
FIG. 4B is a top right perspective view of a portion of the frame of FIG. 3 showing a keeper clip.

FIG. 4B depicts an L-shaped keeper clip that provides a mating of frame 48 with flange 38 of base member 12. Keeper clip 70 may be formed of aluminum, stainless steel, or the like, and allows for thermal expansion of the base member 20 or panel 48. A fastening screw 74 holds keeper clip 70 in place over hook slot 68.

Figure 5:
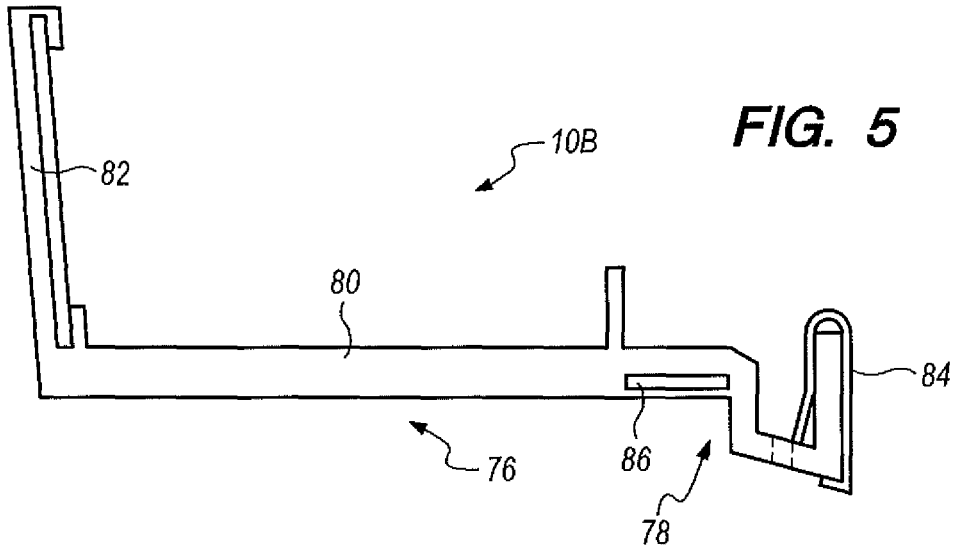
FIG. 5 is a side elevational view of another embodiment of the present application.

FIG. 5 depicts embodiment 10B of the present application. Embodiment 10B includes a base member 76 that includes a flange 78 extending from a platform 80 and connected first portion 82. Flange portion 78 differs from flange portion 38 of base member 12, illustrated in FIGS. 1-4 in that a wear strip 84 is shown and a slot 86 is formed in platform 80 in a horizontal orientation.

Figure 6:
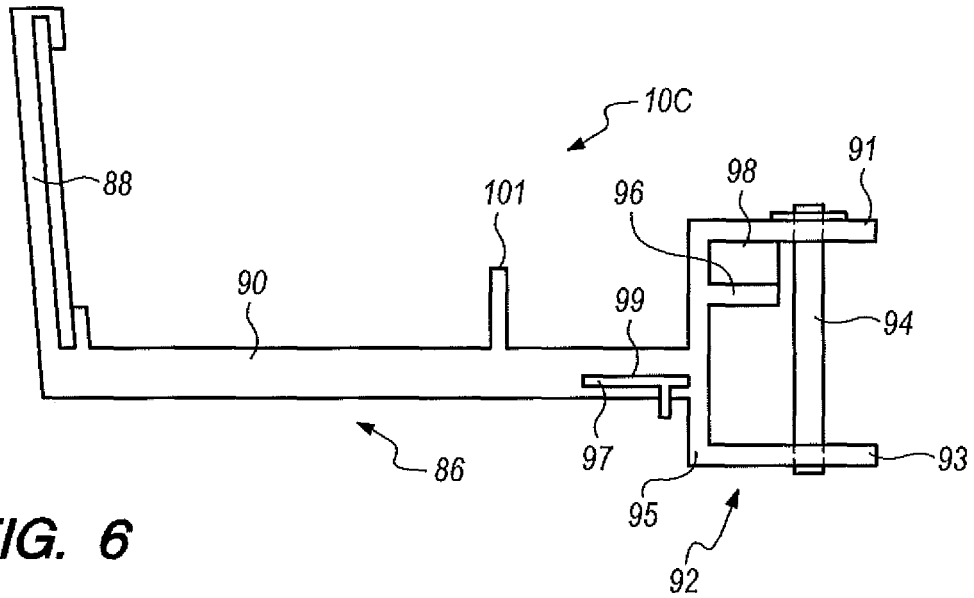
FIG. 6 is a side elevational view of another embodiment of the present application.

FIG. 6 shows another embodiment 10C of the system of the present application. A base member 86 is shown having a first portion 88 with an extending platform 90 terminating in a flange 92. Flange 92 includes clevis and cotter pin 94 which spans arms 91 and 93 of U-shaped end 95. It should be noted that this hook and pin style mount is used instead of the hook and rail system shown in FIG. 3. An alignment strip 97 fits in a slot 99 while fin 101 serves as a lateral support for any insulation lying atop platform 90 and also serves as a weather stop. Reveal guide 96 holds reveal strip 98 within U-shaped end 95. Fin 101 holds insulation members and creates a weather stop.

Figure 7:
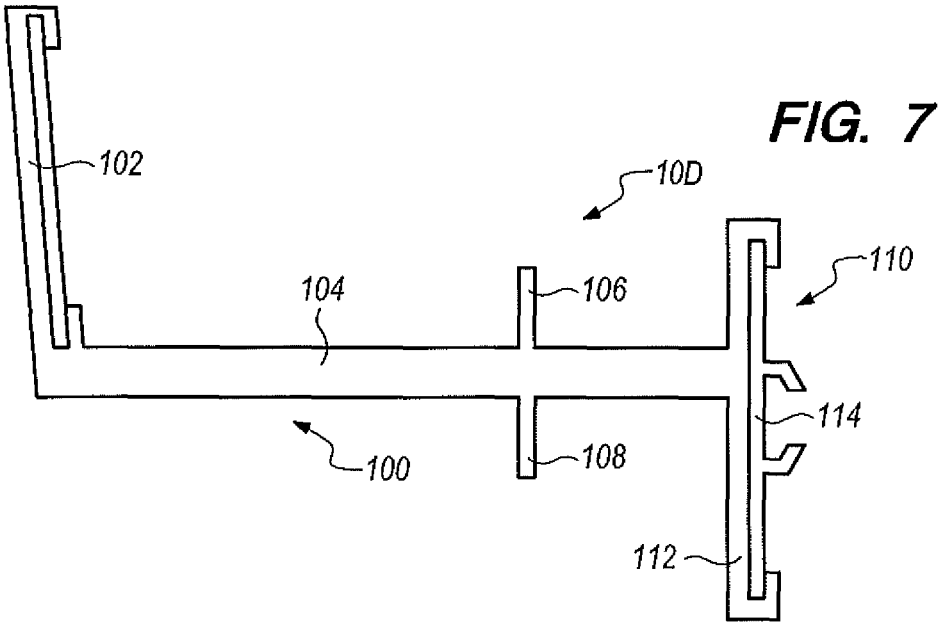
FIG. 7 is a side elevational view of another embodiment of the present application.

Turning to FIG. 7, it may be observed that another embodiment 10D of the present application is shown. Again, base member 100 includes a first portion 102 and an extending platform 104. Fins 106 and 108 again serve as insulation positioners and weather stops. Flange 110 is fashioned with a guide 112 which supports a 2-way strip 114 of conventional configuration. It should be noted that two-way strip 114 is slidable into guide 112 and positioned for use as needed.

Figure 8:
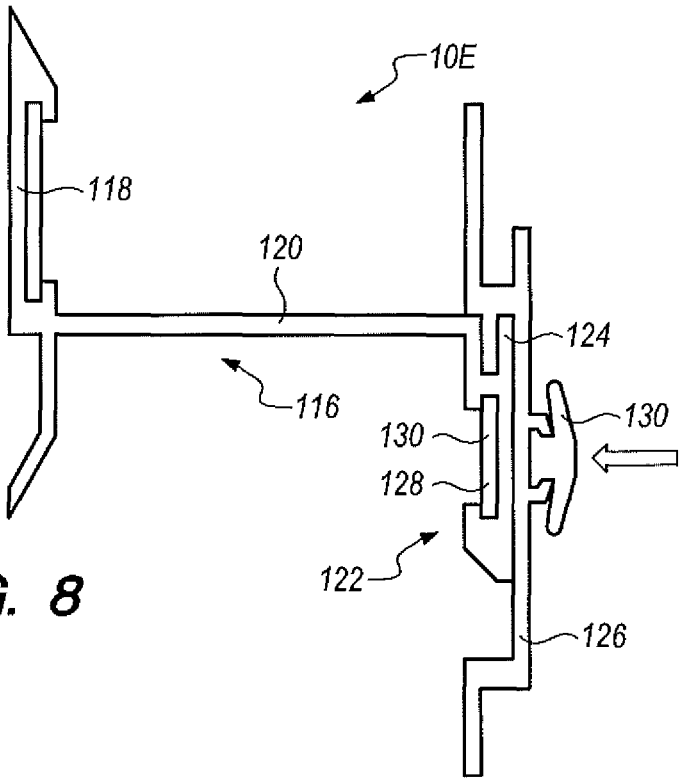
FIG. 8 is a side elevational view of another embodiment of the present application with a prior art T-type fastener indicated as attaching to a portion of the same.

Looking now at FIG. 8, it may be observed that yet another embodiment 10E is revealed. Embodiment 10E shows a base member 116 having a first portion 118 with an extending platform 120. Flange 122 includes a bracket 124 holding a two-way plate 126. A slot 128 accommodates a strip 130. Fastener 130 is a T type fastener of prior art design shown in U.S. Pat. No. 9,903,123. In other words, fastener 130 of prior art genre may be used with the system of the present application depicted in FIGS. 7 and 8.

It should be understood, that the embodiments shown in FIGS. 5-8 are all intended to lie against and be fastened to building structure 20, as shown in FIG. 1 and to also hold insulation blocks such as insulation bodies 26 and 62.

Figure 9:
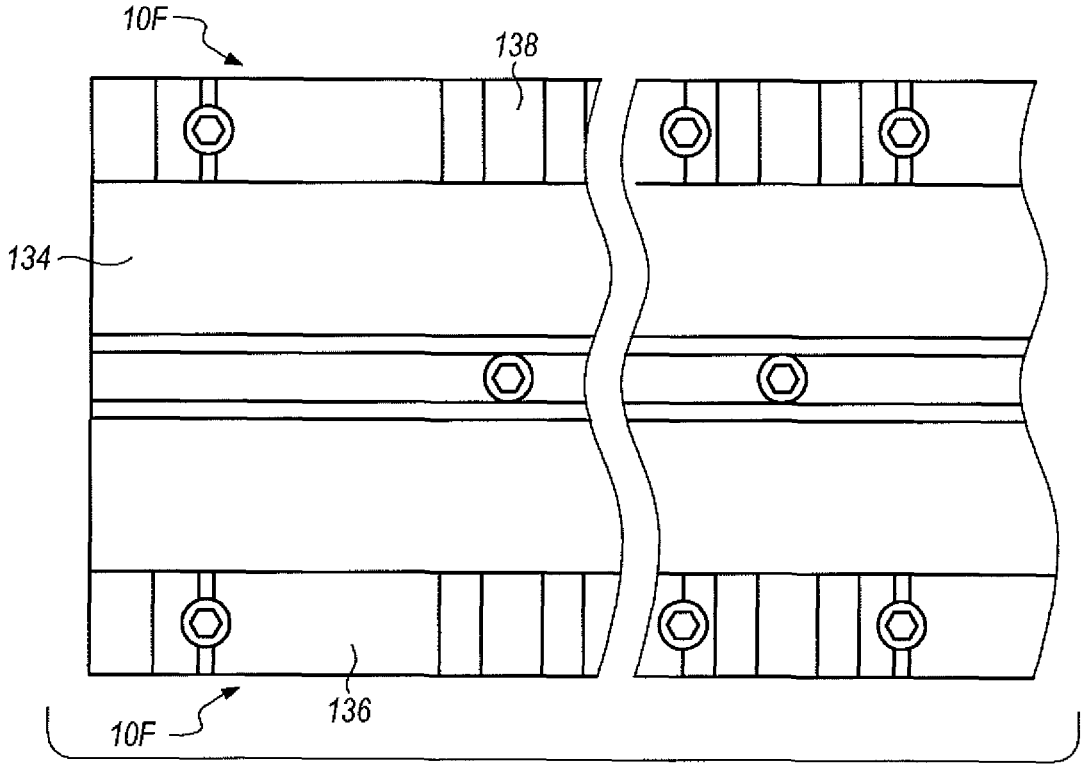
FIG. 9 is a side elevational view of another embodiment of the present application depicting a variety of mounting strips used on the flange portion of a base member.

FIG. 9 shows another embodiment 10F of the present application in which two-way extrusion segment 134 is depicted but includes the addition of inserts 136 and 138 to provide 4-way capabilities. Segments 134 may be fastened to the flange portion 124 of the embodiment shown in FIG. 8. As heretofore described, two-way connections hold two abutting frames or panels, while four-way connections support four meeting panels or frames.

Figure 10:
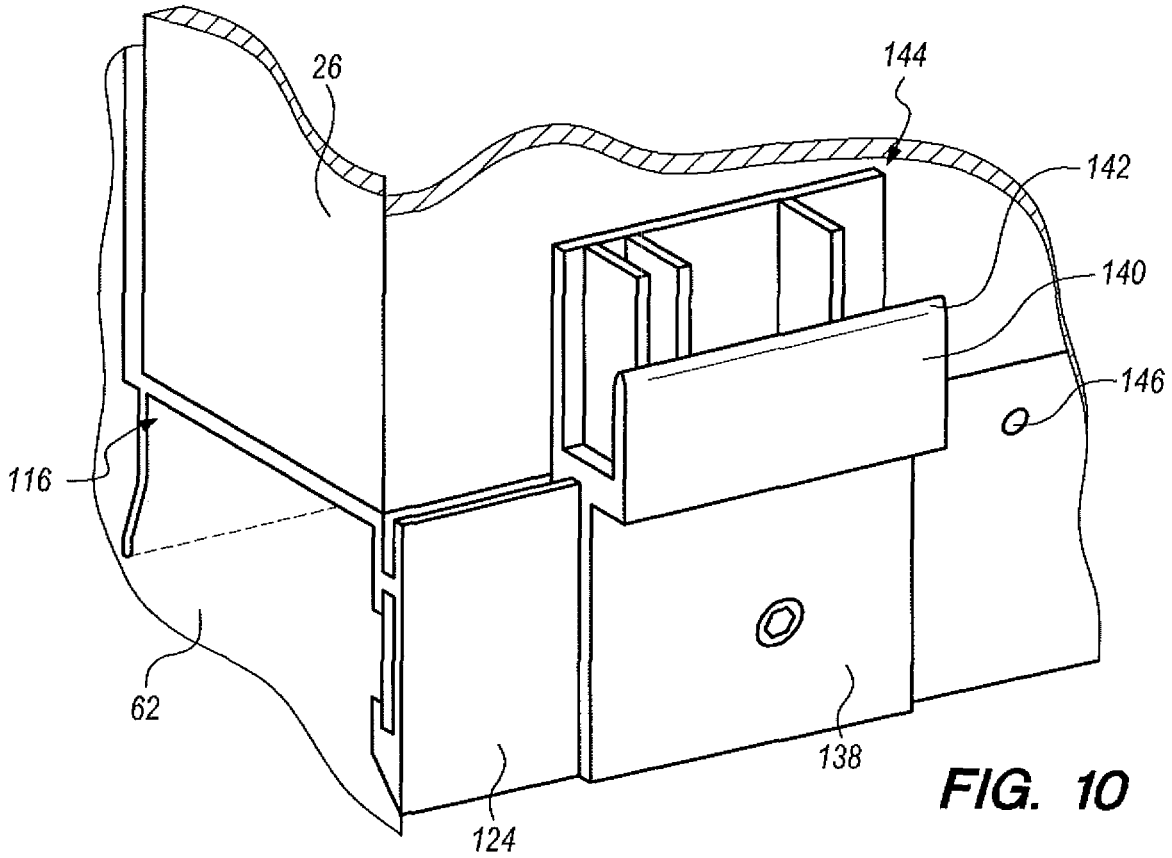
FIG. 10 is a top left side perspective view of another embodiment of the present application including a connector segment used in combination with a base extrusion.

FIG. 10 illustrates the same base 124 as shown in FIG. 8 without the reveal keeper and mounting clips. A segment 140 is employed and includes a terminal wear strip 142 to engage a panel or frame in the same manner as shown in FIG. 3. Reveal guide and 4-way intersection flanges 144 are depicted within segment 140. Opening 146 is employed to allow drainage from flange 124.

Figure 11:
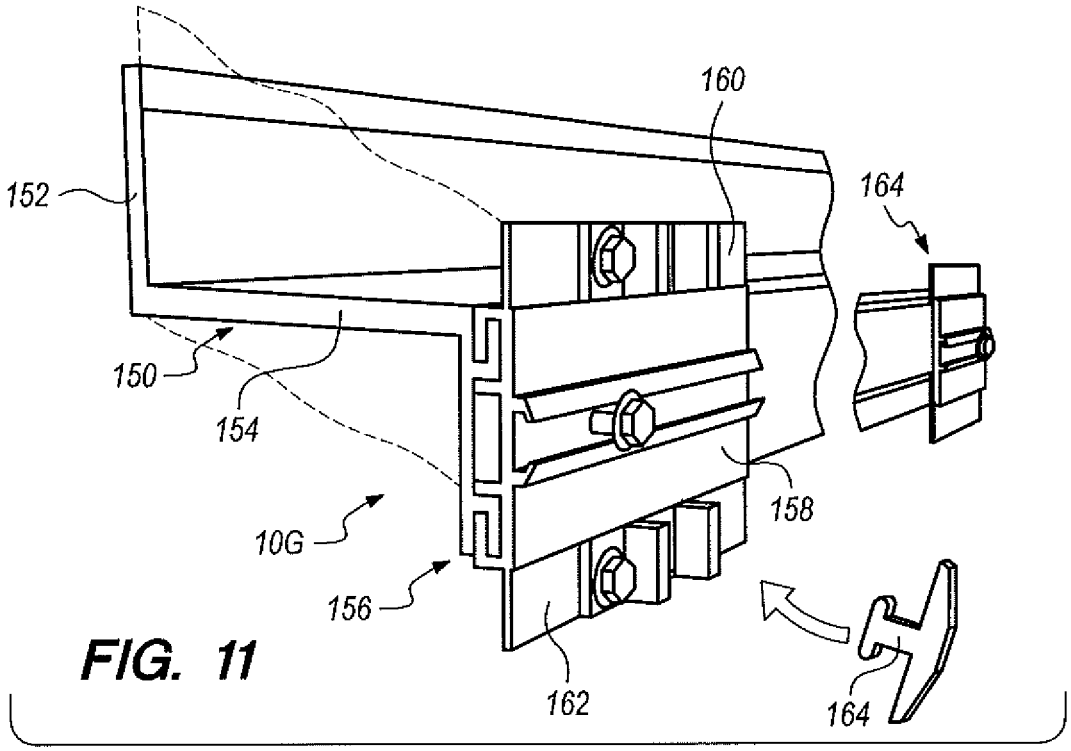
FIG. 11 is a top left side perspective view of another embodiment of a connector strip or segment used in combination with the flange of a base member.

FIG. 11 shows another embodiment 10G of the present application in which a base member 150 includes a first portion 152, a platform 154, and a flange 156. A two-way segment 158 is fastened to flange 156 and includes 4-way extension 160 and 162. Again, two-way segment 158 may slide along flange 156 of base member 150. A simple two-way segment 164 may also slidingly engage flange 156 of base member 150. Likewise, fastener 164 may be employed to hold panels and frame in place.

Figure 12:
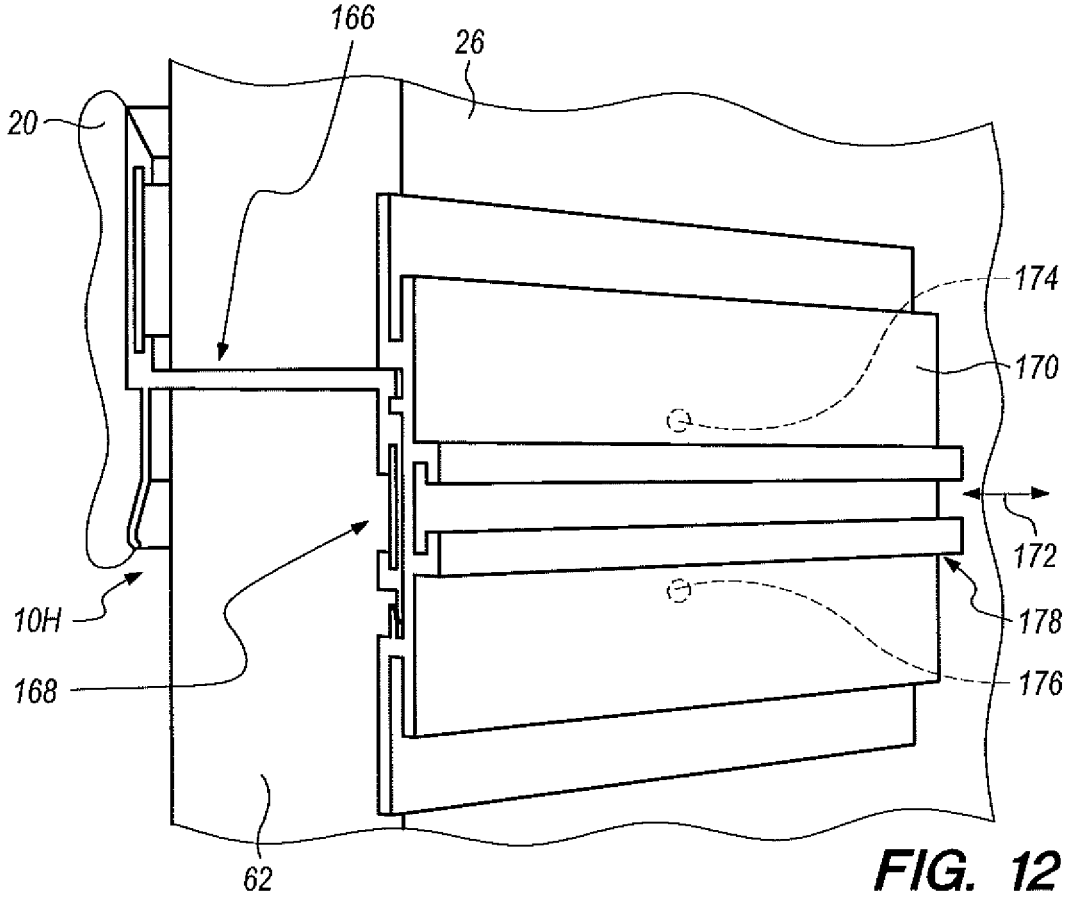
FIG. 12 is a perspective view of another embodiment of a connector used in combination with the flange of a base member.

FIG. 12 depicts yet another embodiment of the present application 10H in which a base member 166 fastens to the building structure 20 and includes a flange 168 and a segment 170. Segment 170 is able to snap into place on flange 168 and slide according to directional arrow 172 along flange 168. Once the position of segment 170 is determined, it may be fastened into place against flange 168 by the use of fasteners 174 and 176 (shown in phantom). Again, segment 170 includes rails 178 that are compatible with conventional connection systems for panels and frames to create a facade on building structure 20.

Figure 13:
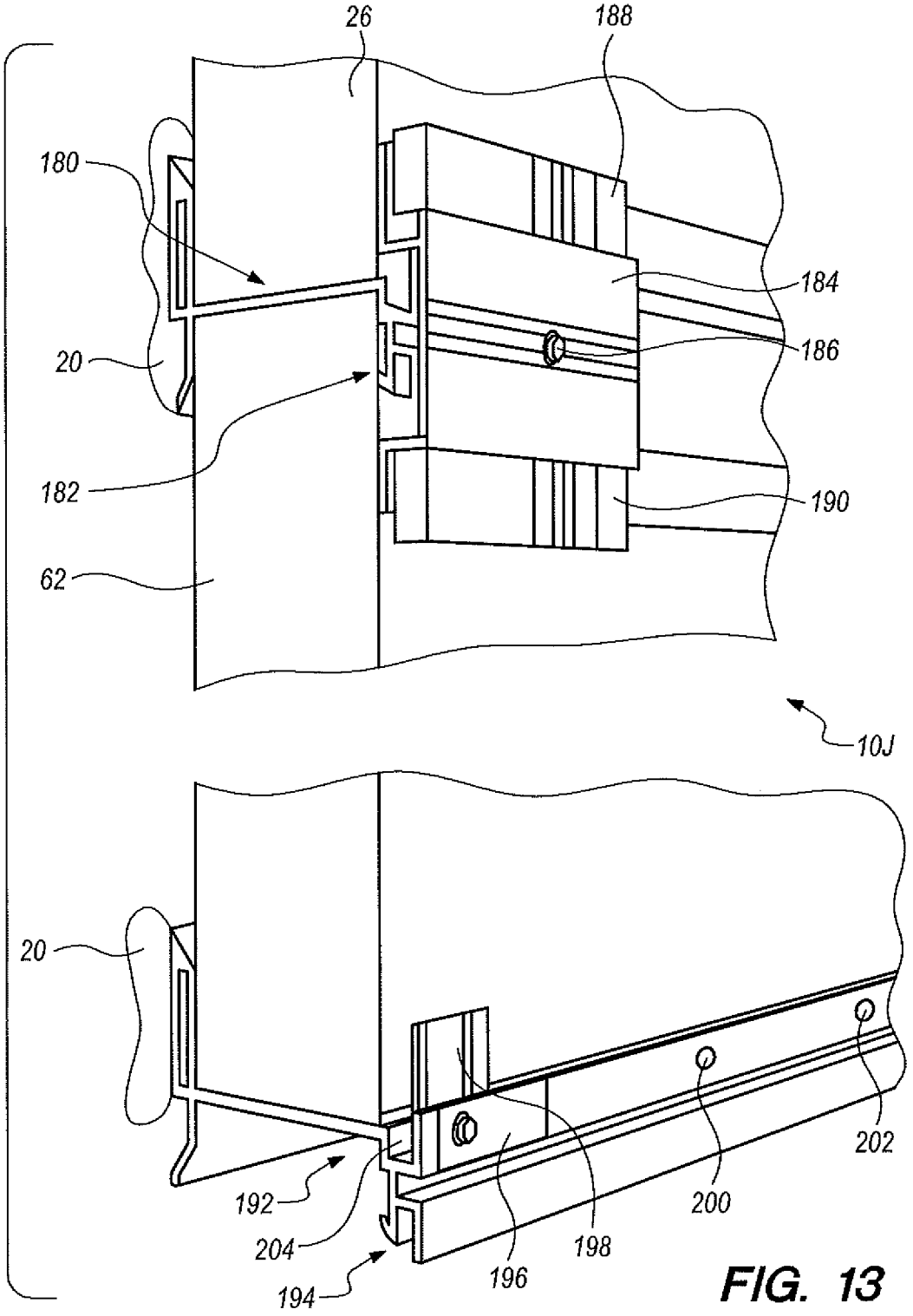
FIG. 13 is a top left side perspective view showing another embodiment of connector elements used in conjunction with base extrusions of the present application.

With reference now to FIG. 13, it may be observed that yet another embodiment 10J of the present application is depicted. A base member 180 that fastens to building structure 20 and includes a flange 182. Two-way segment 184 fastens to flange 182 via fastener 186. Segment extensions 188 and 190 permit a four-way connection for frames and panels in a conventional manner. In addition, a base member 192 is illustrated as being fastened to building structure 20 with a flange 194 that supports a sliding segment 196 that includes an extension 198 that would provide for a two-way connection. Drain holes 200 and 202 allow water to pass from gutter 204 found on base member 192.

While in the foregoing embodiments of the application have been set forth in considerable detail for the purpose of making a complete disclosure of the invention, it may be apparent to those of skill in the art that numerous changes may be made in such detail without departing from the spirit and principles of the invention.

What is claimed is:

1. A facade mounting system for a structure, for holding at least one facade item to the structure, comprising:

an insulation body;

a base member, said base member comprising a first portion, said first portion including one surface for being positioned against the structure, and a platform, said platform extending from said first portion, said platform possessing one surface configured for supporting said insulation body;

said base member further comprising a flange extending from said platform, said flange including a gutter and external wear strip adjacent said gutter, said flange further comprising a protrusion spaced from said wear strip;

a frame, said frame comprising a slot, said slot engaging said terminal wear strip, and said protrusion bearing against said frame, said frame supporting said at least one facade item; and said platform of said base member forming a cavity sized to accommodate said insulation body.

2. The system of claim 1 in which said first portion of said base member comprises another surface lying adjacent said insulation body, said another surface further comprising a beveled portion.

3. The system of claim 2 in which said first portion further comprises a slot and a strip lying in said slot.

4. The system of claim 2 in which said platform further comprises a fin extending from said platform.

5. The system of claim 2 in which said gutter further comprises at least one drain aperture.

6. The system of claim 2 in which said flange further comprises a slot and a strip fastened in said slot apart from said gutter.

7. The system of claim 2 which additionally comprises a plate for maintaining the mating of said latch with said flange.

* * * * *